US007390213B2

(12) United States Patent
Iino et al.

(10) Patent No.: US 7,390,213 B2
(45) Date of Patent: Jun. 24, 2008

(54) CONNECTOR WITH IMPROVED ELECTRICAL CONTACTS

(75) Inventors: Koichi Iino, Yokohama (JP); Guo-Jian Shen, Kunshan (CN); Chi Zhang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/809,075

(22) Filed: May 31, 2007

(65) Prior Publication Data

US 2007/0278085 A1 Dec. 6, 2007

(30) Foreign Application Priority Data

May 31, 2006 (CN) ..... 2006 2 0073400 U

(51) Int. Cl.
*H01R 12/24* (2006.01)

(52) U.S. Cl. ..... 439/495

(58) Field of Classification Search ..... 439/495, 439/496, 260

See application file for complete search history.

(56) References Cited

U.S. PATENT DOCUMENTS

| | | | | |
|---|---|---|---|---|
| 6,099,346 | A | 8/2000 | Hashiguchi et al. | |
| 6,379,177 | B1 * | 4/2002 | Chang | 439/495 |
| 7,052,300 | B2 * | 5/2006 | Okita et al. | 439/260 |
| 7,086,884 | B2 * | 8/2006 | Okano | 439/260 |

* cited by examiner

*Primary Examiner*—Phuong K T Dinh
(74) *Attorney, Agent, or Firm*—Wei Te Chung

(57) ABSTRACT

An electrical connector comprises an insulative housing (1) defining a receiving cavity (14); a plurality of contacts (2, 3) disposed in the housing, each contact comprising a contact beam (21, 31) with a contact portion (210, 310) exposed to the receiving cavity and a pivot beam (22, 32) extending opposite to the corresponding contact beam; and an actuator comprising a plurality of grooves (421) at its rear end for receiving head portions of the pivot beams of the contacts and a plurality of shaft portions (422, 423) in the grooves. Some contact defines cutouts (320) which extend through corresponding front surfaces of the head portions for receiving the shaft portions therein, and other contacts define recesses (220) at the head portions for receiving the other shaft portions to prevent the actuator breaking off the contacts.

3 Claims, 5 Drawing Sheets

CONNECTOR WITH IMPROVED ELECTRICAL CONTACTS

BACKGROUND OF THE INVENTION

1. Field of the Invention

The present invention relates to an electrical connector, and more particularly to an electrical connector for a sheet-like connection member such as a flexible printed circuit or a flexible flat cable.

2. Description of Related Art

U.S. Pat. No. 6,099,346 discloses a conventional connector adapted for connecting a flexible printed circuit (FPC). The FPC connector includes a housing having a receiving cavity, a plurality of electrical contacts arranged and secured in the housing, each contact having a contact beam exposed to the receiving cavity for contacting the FPC and a pivot beam corresponding to and opposed to the contact beam, and an actuator rotatable between an open position where said FPC can be inserted into said receiving cavity and a closed position where said FPC is pressed to electrically engage with said contacts. Each pivot beam of said contact is formed with a hook-like end providing a recess, and the actuator defines a plurality of grooves for receiving said hook-like ends. Each groove has a shaft portion for engaging with the recess of contact.

As the actuator is made by inserting molded, it is possible for the shaft portions to be located to align with each other in a longitudinal direction of the actuator. However, as the contacts are assembled into the housing by operators or machines, it is hardly make all of the recesses of the contacts for receiving the shaft portions to align with each other in the longitudinal direction. As a result, if one or more contacts bias away their required position, the contacts may prohibit the actuator to be completely mounted on the electrical connector. Even if the actuator were mounted with a strong hand, the contacts would affect the movement of the actuator between the opened position and the closed position. Therefore, a new connector is desired to overcome the disadvantage of the prior art connector or at least prevent the above-mentioned problem taking place frequently.

SUMMARY OF THE INVENTION

An object of the present invention is to provide an electrical connector with an actuator which can be accurately mounted thereon.

In order to achieve above-mentioned objects, an electrical connector for a sheet-like connection member in accordance with the present invention comprises an insulative housing defining a receiving cavity; a plurality of contacts disposed in the housing, each contact comprising a contact beam with a contact portion exposed to the receiving cavity and a pivot beam extending opposite to the corresponding contact beam; and an actuator assembled to the housing comprising a plurality of grooves at its rear end for receiving the head portions of pivot beams of the contacts and a plurality of shaft portions. Some contact defines cutouts which all extend through corresponding front surfaces of the head portions for receiving the shaft portions therein, and other contacts define recesses at the head portions for receiving the other shaft portions to prevent the actuator breaking off the contacts.

Other objects, advantages and novel features of the present invention will become more apparent from the following detailed description of the present embodiment when taken in conjunction with the accompanying drawings.

DETAILED DESCRIPTION OF THE INVENTION

Figure 1:
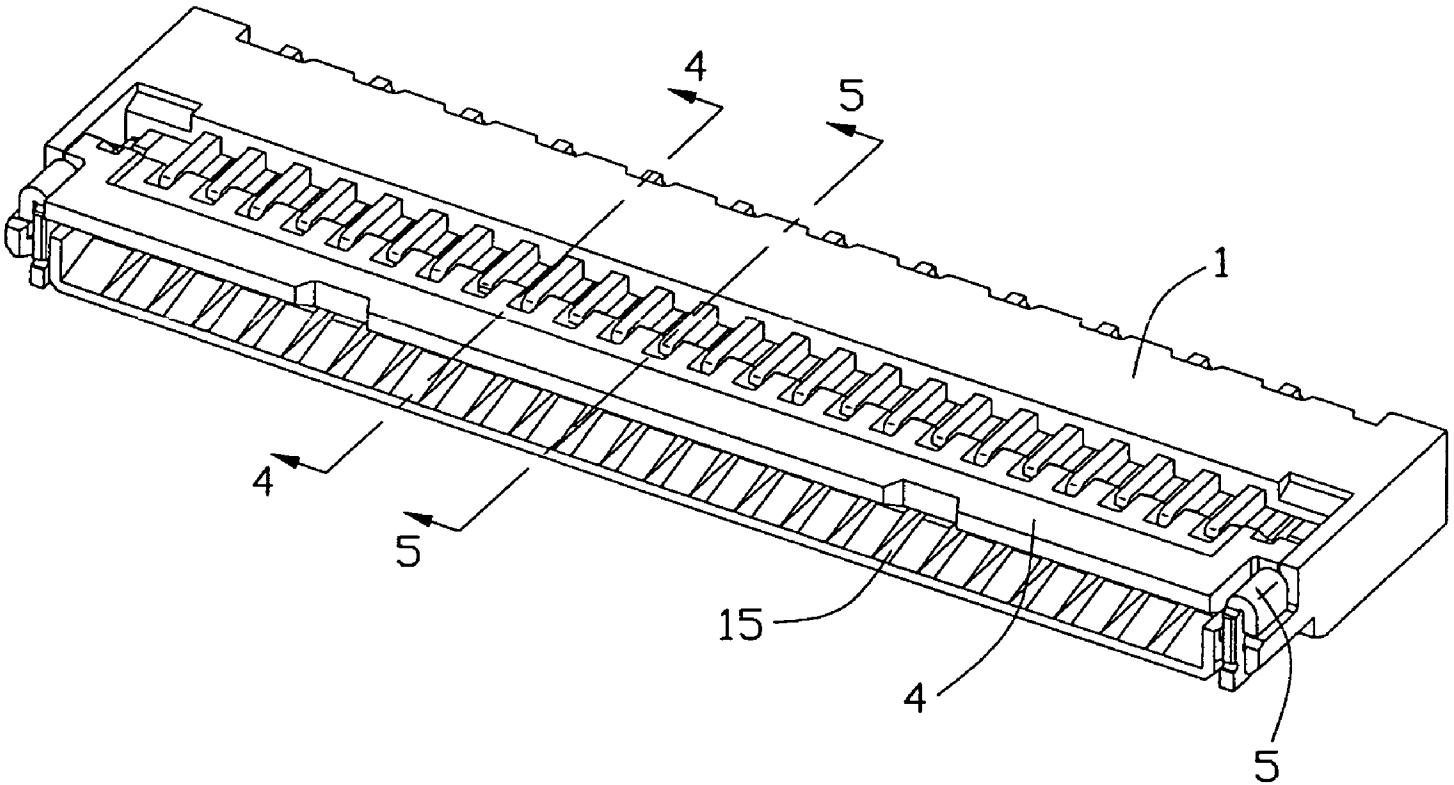
FIG. 1 is an assembled perspective view of an electrical connector in accordance with the present invention.

Reference will now be made to the drawing figures to describe the preferred embodiment of the present invention in detail.

Figure 3:
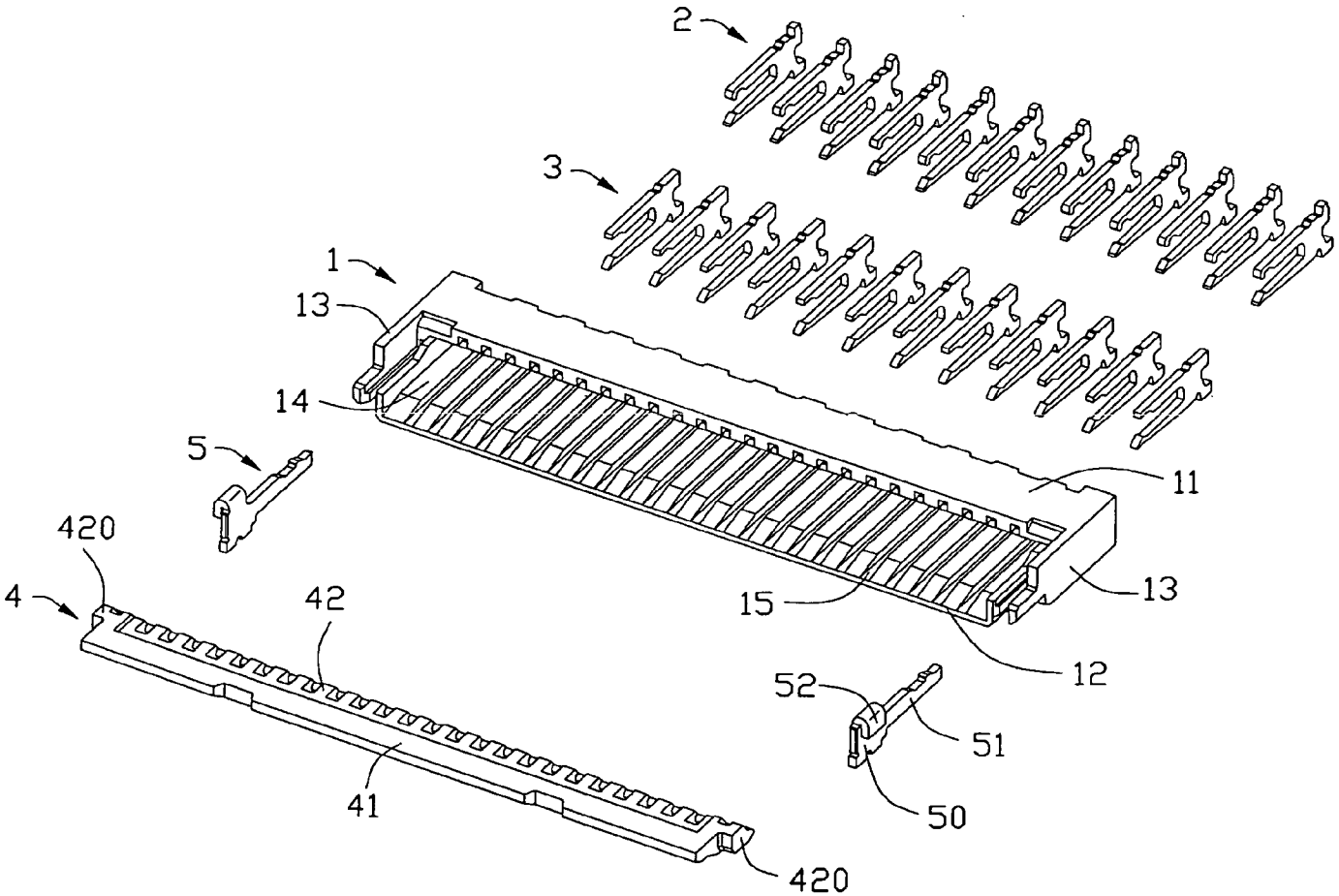
FIG. 3 is an exploded perspective view of the electrical connector.

Referring to FIG. 3, an electrical connector for connecting a sheet-like connection member (not shown) with a printed circuit board (PCB, not shown) in accordance with the present invention is provided. The electrical connector comprises an insulative housing 1 defining a longitudinal direction, a plurality of first and second contacts 2, 3 disposed in the housing 1, an actuator 4 and a pair of support members 5.

Figure 2:
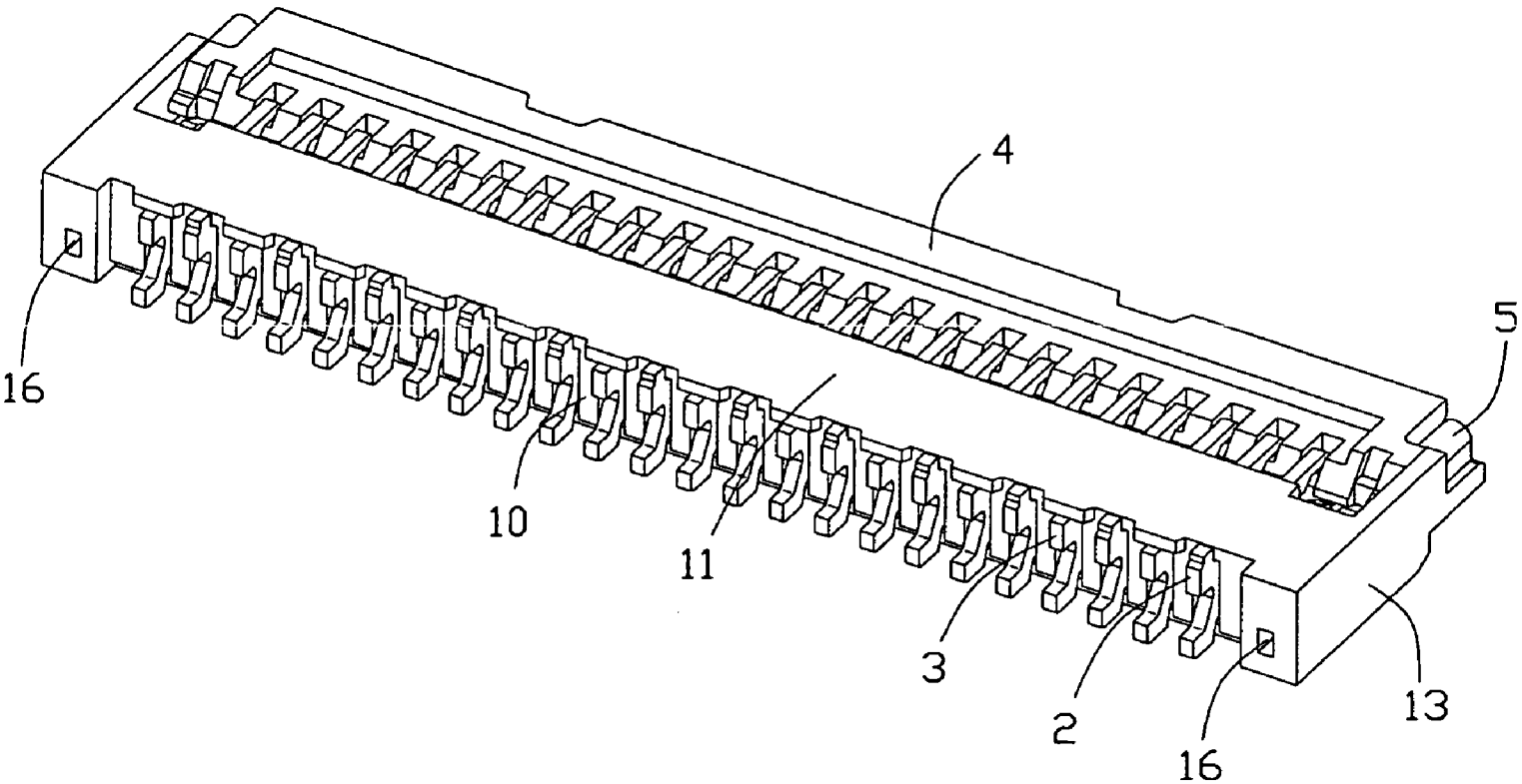
FIG. 2 is a similar view of FIG. 1, but taken from another view.

Referring to FIGS. 2 and 3, the housing 1 comprises a base 10 extending along said longitudinal direction, a top wall 11 and a bottom wall 12 opposite to and parallel to each other and a pair of lateral wall 13. The base 10 cooperates with the walls to form a receiving cavity 14 for receiving the sheet-like connection member along a front-to-back direction perpendicular to said longitudinal direction. The top and bottom walls 11, 12 defines a plurality of channels 15 for retaining said first and second contacts 2, 3 therein. Each lateral wall 13 has a retaining groove 16 for accommodating the corresponding support member 5.

Figure 4:
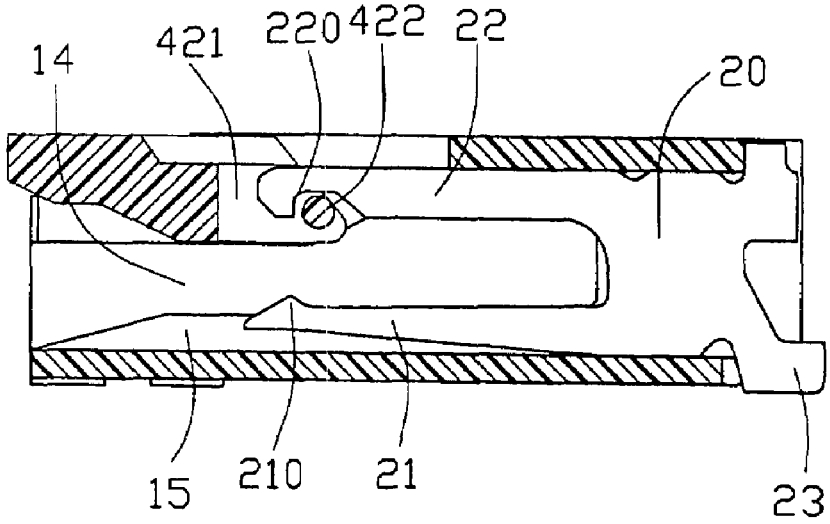
FIG. 4 is a cross-sectional view of FIG. 1, taken along line 4-4.

Referring to FIGS. 3, 4 and, each of the first and second contacts 2, 3 has a retention portion 20, 30 for securing the contacts 2, 3 firmly in the channels 15, a contact beam 21, 31 with a contact portion 210, 310 exposed to the receiving cavity 14 and extending forward from the retention portion 20, 30, a pivot beam 22, 32 extending parallel to and opposite to the contact beam 21, 31 and a solder legs 23, 33 extending rearward from the retention portion 20, 30 for connecting on the printed circuit board. Each pivot beam 22 of the first contact 2 has a hook-like head portion provided with a recess 220 opening to the receiving cavity 10, while each pivot beam 32 of the second contact 2 has a head portion provided with a cutout 320 extending forward through a front surface of the pivot beam 32. In other words, a bottom surface of the cutout 320 is a substantially flat surface. In this embodiment, the first and second contacts 2, 3 are alternately mounted to the housing 1 from rear end of the housing 1. Certainly, the first and second contacts 2, 3 also can be arranged in other types according to demand.

Figure 5:
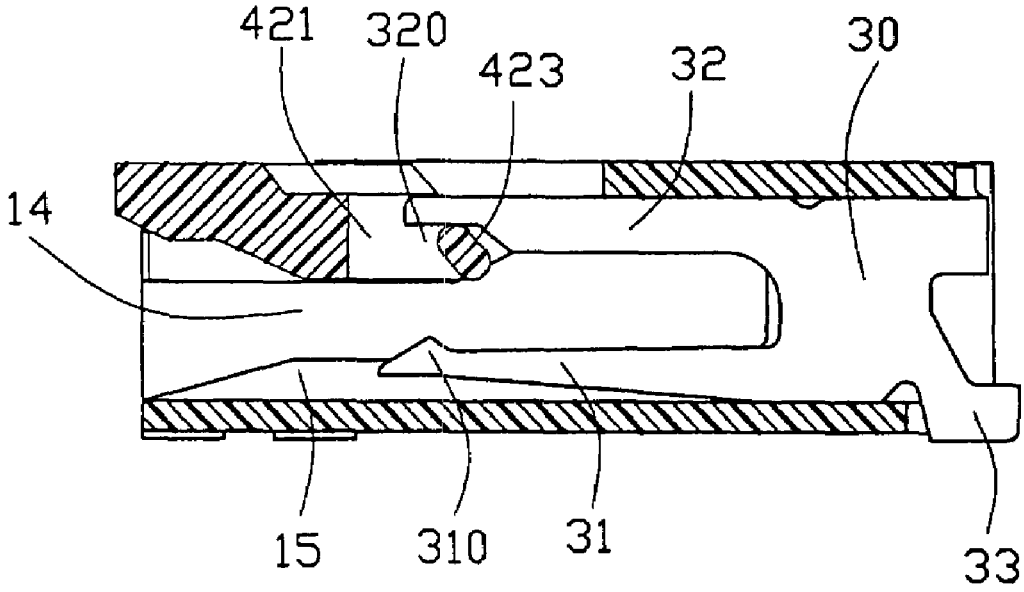
FIG. 5 is a cross-sectional view of FIG. 1, taken along line 5-5.

Referring to FIGS. 3 to 5, the actuator 4 is formed into a planar shape so as to open and close an upper portion of the receiving cavity 10. In order to engage with the housing 1 and the contacts 2, the actuator 4 has a comb-like connection portion 42 located at a rear portion thereof and a plate portion 41 providing operating area for operators. The connection portion 42 comprises a plurality of grooves 421 for receiving the head portions of the first and second contacts 2, 3 and a pair of bosses 33 on two sides of all grooves 421 adapted to be held on the support members 5 installed in both lateral walls of the housing 1. Some of grooves 421 which receive the head portions of the first contact 2 respectively form shaft portions 422 with a round shape (called rounded shaft portions or holding portions 422), while the other grooves which receive the head portions of the second contacts 3 form shaft portions 423 with a cam shape (called cam shaft portions or urging portions 423). The actuator 4 is rotatably movable relative to the housing 1 between an opened position and a closed position. When the actuator 4 is the opened position, the sheet-like connection member is inserted into the receiving cavity 14. When the actuator 4 is in the closed position, the cam shaft portions 423 and wedge portions located between shaft portions 422, 423 press the sheet-like connection member to electrically connect with the contact portions 210, 310 of the contacts 2, 3.

As the cutouts 320 extends through the front surface of the pivot beam 32 of the second contact 3, the actuator 4 can be completely assembled to the electrical connector even if the second contacts 3 are not located to align with each other in the longitudinal direction. Further, when the actuator 4 is in the closed position, the rounded shaft portions 422 are received in the recesses 220 but not contacting with inner surfaces of the recesses 220 of the first contacts 2. The rounded shaft portions 422 can prevent the actuator 4 breaking off the contacts 2 during the movement of the actuator 4. Therefore, even if some first or second contacts are assembled to unrequited positions of the housing 1, the actuator 4 still can be completely assembled to the housing 1. The shaft portions also can be designed in other shape as long as they can act the same functions as the rounded shaft portions 422 and the cam shaft portions 423.

Referring to FIG. 3, each support member 5 has a main portion 50 having a bottom surface for soldering on the printed circuit board, an extended beam 51 extending rearward and a latching portion 52 which is bent from the main portion 50 to latch onto the lateral wall of the housing 1. The extended beams 51 supports the bosses 420 of actuator 4 rotary moving thereon, and distal ends of the extended beams 51 are respectively retained in the retaining grooves 16 so that the support members 5 are firmly fixed in the housing 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for connecting with a sheet-like connection member, comprising:

an insulative housing defining a receiving cavity and a plurality of channels which are in communication with the receiving cavity;

a plurality of contacts disposed in the corresponding channels, each contact comprising a contact beam with a contact portion exposed to the receiving cavity and a pivot beam extending opposite to the corresponding contact beam and having a distal head portion, some head portions of the contacts define recesses opening only to the receiving cavity, and the other head portions of the contacts define cutouts which all extend through corresponding front surfaces of said other head portion; the cutouts being without any retention feature at their front ends; and an actuator pivotally assembled to the electrical connector and movable between an opened position and a closed position, the actuator comprising a plurality of grooves at its rear end for receiving the head portions of the contacts and a plurality of shaft portions in the grooves, some shaft portions received in the recesses of some head portions, and other shaft portions received in the cutouts of said other head portions wherein the shaft portions received in the recesses are in round shape, wherein the shaft portions received in the cutouts in cam shape, wherein when the actuator is in the closed position, the shaft portion is round shape are not contacting with inner surfaces of the recesses of the contacts, wherein the actuator is in the closed position, the shaft portion in cam shape press the press the sheet-like connection member to electrically contact with the contact portions of the contact, wherein the contact with the recesses and the other contacts with the cutouts are alternatively assembled into the housing, wherein the actuator has a pair of boxes located at two sides of all groove.

2. An electrical connector comprising:

an insulative housing defining therein a receiving cavity for receiving an FPC (Flexible Printed Circuit) therein, and a plurality of passageways communicating with said receiving cavity;

first and second groups of contacts alternately disposed in the corresponding passageways, respectively;

each of said first group of contacts defining a recess at a front end while each of said second group of contacts defining a step at a front end; and a pivotal actuator defining a plurality of grooves along an edge region and receiving the front ends of the corresponding first and second groups of contacts, a plurality of holding portions and urging portions alternately disposed in the corresponding grooves under a condition that the holding portion is restrained in the corresponding recess, but serves no urging function, and the urging portion is engaged with the corresponding step so as to assure a force imposes upon the actuator by the second group of contacts wherein each of said first and second groups of contacts further defining a contact section opposite to the corresponding recess or step for cooperating with the actuator to sandwich said FPC therebetween, wherein said holding portion defines a round shape while said urging portion defines a cam shape, wherein said step is open forwardly so as not to restrict the corresponding urging portion from moving accordingly.

3. An electrical connector comprising:

an insulative housing defining therein a receiving cavity for receiving an FPC (Flexible Printed Circuit) therein, and a plurality of passageways communicating with said receiving cavity;

first and second groups of contacts disposed in the corresponding passageways, respectively; and a pivotal actuator defining first and second protrusions along a front edge thereof; wherein the first group of contacts are configured to cooperate with the corresponding first protrusions to only bring about a tension between the actuator and the first group of contacts so as to efficiently urge the FPC, while the second group of contacts are configured to cooperate with the corresponding second protrusions to only restrain the corresponding second protrusion from escaping therefrom without providing wherein the first protrusion is of a cam shape, wherein each of the second group of contacts forms a recess to prevent the corresponding second protrusions from moving along a mating direction of said FPC with regard to the housing.

* * * * *